United States Patent [19]

Ohyoshi et al.

[11] Patent Number: 4,861,016

[45] Date of Patent: Aug. 29, 1989

[54] DELIVERY SAFETY APPARATUS FOR SHEET-FED PRINTING PRESS

[75] Inventors: Hisaaki Ohyoshi; Nobuaki Saito, both of Ibaraki, Japan

[73] Assignee: Komori Printing Machinery Co., Ltd., Japan

[21] Appl. No.: 247,253

[22] Filed: Sep. 21, 1988

[30] Foreign Application Priority Data

Sep. 22, 1987 [JP] Japan ..... 62-236162

[51] Int. Cl.[4] ..... B65H 43/04

[52] U.S. Cl. ..... 271/215; 271/217; 101/233; 414/926

[58] Field of Search ..... 101/238, 232, 233, 237, 101/239, 240, 241, 242, 247; 271/215, 217; 414/98, 99, 100

[56] References Cited

U.S. PATENT DOCUMENTS

| | | | |
|---|---|---|---|
| 2,859,965 | 11/1958 | Pabst et al. | 271/215 |
| 2,861,805 | 11/1958 | Auer | 271/215 |
| 3,682,328 | 8/1972 | Turner et al. | 271/215 |
| 3,703,283 | 11/1972 | Abendroth et al. | 271/215 |
| 3,747,920 | 7/1973 | Linkus | 271/215 |
| 4,033,579 | 7/1977 | Stange et al. | 271/217 |
| 4,189,133 | 2/1980 | Arrasmith et al. | 414/100 |
| 4,455,115 | 6/1984 | Alger | 414/98 X |
| 4,536,119 | 8/1985 | Miaskoff | 414/100 |
| 4,625,641 | 12/1986 | Jagosz et al. | 101/240 |

*Primary Examiner*—E. H. Eickholt

*Attorney, Agent, or Firm*—Remy J. VanOphem

[57] ABSTRACT

In a delivery safety apparatus for a sheet-fed printing press, regardless of the operation mode of the delivery table lifting unit, a delivery table is automatically moved downward on the basis of a detection result from a pile height detecting means for detecting a sheet pile height exceeding a predetermined position for sheets delivered and stacked on the delivery table. If automatic descending of the delivery table is not started even when a predetermined period of time has elapsed, this abnormal state is detected, and an alarm is generated. When automatic descending is not yet started when another predetermined period of time has elapsed after the alarm is generated, this abnormal state is detected to interrupt delivery of sheets onto the delivery table.

1 Claim, 2 Drawing Sheets

DELIVERY SAFETY APPARATUS FOR SHEET-FED PRINTING PRESS

BACKGROUND OF THE INVENTION

The present invention relates to a delivery safety apparatus for a sheet-fed printing press wherein a sheet pile height exceeding a predetermined position for sheets sequentially delivered and stacked on a delivery table is detected in the sheet-fed printing press, and the delivery table is safely automatically moved downward.

A vertically movable delivery table suspended by lifting chains at four corners thereof is arranged in a delivery apparatus in a sheet-fed printing press. At the start of printing, a pallet which can be lifted by a lift arm or the like is placed on the delivery table. Printed sheets are conveyed while their leading edges are gripped by grippers of delivery chains. The trailing edge of each printed sheet is sucked by a suction wheel at the end of conveyance, so that the printed sheet is decelerated. The printed sheets are released from the grippers above the pallet and are aligned by a jogger and dropped (delivered) on a pile board disposed on the pallet. In this case, the delivery table is controlled to be automatically moved downward while the sheets are stacked on the pile board. In the conventional delivery apparatus for a sheet-fed printing press, a delivery table lifting unit for controlling vertical movement of the delivery table generally includes a mode selection switch for selecting an automatic operation mode or a single operation mode. When the operation mode selection switch is set in the automatic operation mode, a detection signal from a delivery height detector for detecting a height of a pile of sheets stacked on the pile board on the delivery table is generated. The delivery table is automatically moved downward to prevent the height of the stacked sheets from exceeding the predetermined position on the basis of the detection signal.

When a predetermined number of sheets are stacked on the pile board on the delivery table, the next pile board is set to prevent offset of the printed sheets when the predetermined number of printed sheets are stacked on the pile board. The next pile board is set in the single operation mode wherein vertical movement of the delivery table can be arbitrarily performed. Therefore, the delivery table is moved downward by a predetermined amount, and a new pile board is set.

In the conventional delivery apparatus as described above, when a new pile board is set, the operation mode selection switch must be reset from the single operation mode to the automatic operation mode. However, if an operator forgets to change the mode from the single operation mode to the automatic operation mode and if printed sheets exceeding a predetermined number of printed sheets are stacked on the pile board, no detection signal is generated by the delivery height detector. Therefore, the delivery table cannot be automatically moved downward. The stacked sheets are disturbed by the gripper shaft to interrupt printing. In the worst case, the printing press is damaged.

Even in the automatic operation mode, if the delivery table is not automatically moved downward, When an accidental failure occurs, the same inconvenience as described above occurs.

SUMMARY OF THE INVENTION

It is a principal object of the present invention to provide a delivery safety apparatus for a sheet-fed printing press, wherein great improvements are made to prevent interruption of the printing press and damage thereto.

It is another object of the present invention to provide a delivery safety apparatus for a sheet-fed printing press, wherein a safer operation can be assured.

In order to achieve the above objects of the present invention, regardless of the operation mode of the delivery table lifting unit, a delivery table is automatically moved downward on the basis of a detection result from a pile height detecting means for detecting a sheet pile height exceeding a predetermined position for sheets delivered and stacked on the delivery table. If automatic descending of the delivery table is not started even when a predetermined period of time has elapsed, this abnormal state is detected, and an alarm is generated. When automatic descending is not yet started when another predetermined period of time has elapsed after the alarm is generated, this abnormal state is detected to interrupt delivery of sheets onto the delivery table.

According to the present invention, therefore, automatic descending of the delivery table can be performed regardless of the operation mode of the delivery table lifting unit. When automatic descending of the delivery table is not started after a lapse of a predetermined period of time, an alarm is generated. When automatic descending of the delivery table is not yet started after generation of the alarm and a lapse of another predetermined period of time, delivery of the sheets onto the delivery table is interrupted.

DETAILED DESCRIPTION OF THE PREFERRED EMBODIMENT

A delivery safety apparatus for a sheet-fed printing press according to an embodiment of the present invention will be described below.

Figure 2:
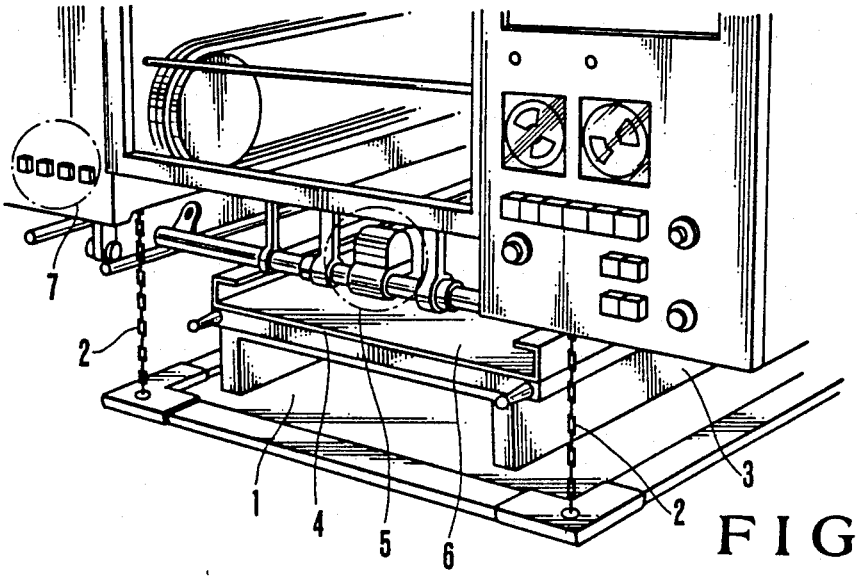
FIG. 2 is a perspective view showing an outer appearance of the delivery apparatus in the sheet-fed printing press which employs the delivery safety apparatus shown in FIG. 1.

FIG. 2 shows a delivery apparatus in the sheet-fed printing press. Referring to FIG. 2, reference numeral 1 denotes a vertically movable delivery table suspended by lifting chains 2 at its four corners; 3, a pallet mounted on the delivery table 1; 4, a pile board placed on the pallet 3; 5, a delivery height detector for detecting a sheet pile height exceeding a predetermined position for sheets 6 delivered and stacked on the pile board 4; and 7, a control switch unit including an operation mode selection switch for selecting an automatic operation mode or a single operation mode of the delivery table 1.

Figure 1:
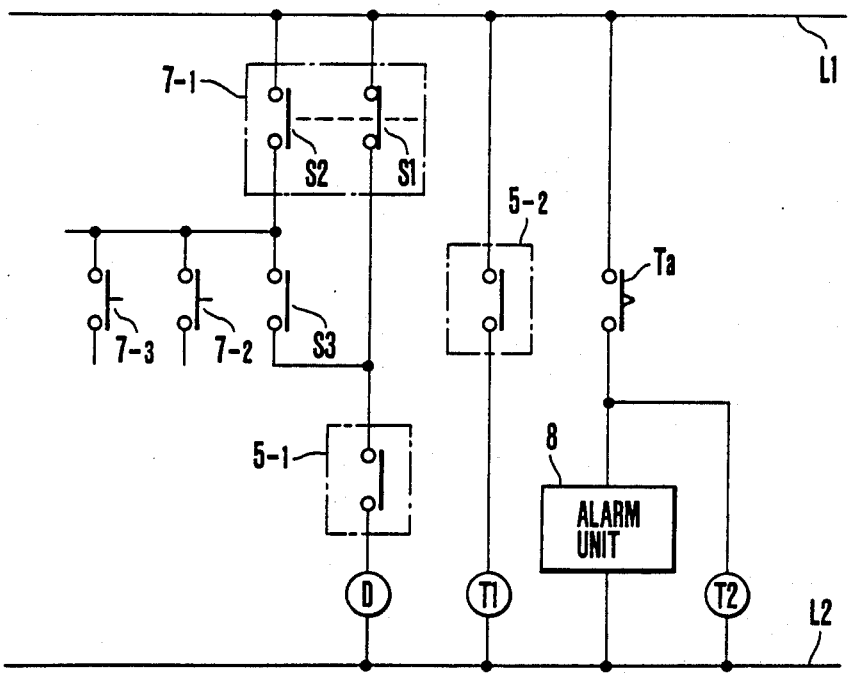
FIG. 1 is a circuit diagram of a delivery safety apparatus for a sheet-fed printing press according to an embodiment of the present invention.

FIG. 1 is a circuit diagram of the delivery safety apparatus in the delivery apparatus in the sheet-fed printing press. A contactor D for designating downward movement of the delivery table 1 in an ON state is connected to power source lines L1 and L2 through a normally open contact 5-1 of the delivery height detector 5 and an automatic mode contact S1 of an operation mode selection switch 7-1. A single mode contact S2 of the automatic mode selection switch 7-1 is connected in parallel with the automatic mode contact S1 through a sheet feed contact S3 which is turned on during feeding of the sheet to the printing press. A time-limit relay T1 is connected to the power source lines L1 and L2 through a normally open contact 5-2 of the delivery height detector 5. An alarm unit 8 is connected to the power source lines L1 and L2 through a time-limit operation normally open contact Ta of the time-limit relay T1. A relay T2 is connected in parallel with the alarm unit 8. When a time-limit operation normally closed contact (not shown) of the time-limit relay T2 is opened, feeding of the sheet to the printing press is interrupted. Reference numerals 7-2 and 7-3 denote single ascending and descending switches connected in series with the single mode contact S2. The operation mode selection switch 7-1, the single ascending switch 7-2, and the single descending switch 7-3 are arranged in the control switch unit 7, as shown in FIG. 2.

An operation of the delivery safety apparatus having the above arrangement will be described below. Assume that the delivery table lifting unit is set in the automatic operation mode, the single mode contact S2 of the operation mode selection switch 7-1 is OFF, and the automatic mode contact S1 is ON. In the automatic operation mode, when the height of a pile of the sheets 6 delivered and stacked on the pile board 4 exceeds a predetermined position, the height of the pile is detected by the delivery height detector 5. The normally open contacts 5-1 and 5-2 are closed. That is, the contactor D is turned on through a path of the automatic mode contact S1 to the normally open contact 5-1. Upon operation of the contactor D, downward movement of the delivery table 1 is started. When the contactor D is turned on, the time-limit relay T1 starts counting through the normally open contact 5-2. When the delivery table 1 is automatically moved downward upon the ON operation of the contactor D, the height of the pile exceeding the predetermined position for the sheets 6 is not detected by the delivery height detector 5. The normally open contacts 5-1 and 5-2 of the delivery height detector 5 are opened to interrupt supply of power to the contactor D and the time-limit relay T1. Automatic descending of the delivery table 1 is interrupted, and the counting operation of the time-limit relay T1 is reset and stopped. That is, whenever the height of the pile stacked on the pile board 4 exceeds the predetermined position, the above operations are repeated. Thus, automatic descending of the delivery table 1 in the automatic operation mode is performed.

When the operation mode of the delivery table lifting unit is changed from the automatic operation mode to the single operation mode, that is, when the automatic mode contact S1 of the operation mode selection switch 7-1 is turned off and the single mode contact S2 thereof is turned on, the sheet feed contact S3 is kept on during sheet feeding. When the height of a pile of the sheets 6 delivered and stacked on the pile board 4 exceeds the predetermined position, the height of the pile is detected by the delivery height detector 5. Its normally open contact 5-1 is closed, and the contactor D is turned on through a path of the single mode contact S2, the sheet feed contact S3, and the normally open contact 5-1. Therefore, downward movement of the delivery table 1 is started. More specifically, even in the single operation mode, the closing operation of the normally open contact 5-1 of the delivery height detector 5 is enabled. Automatic descending of the delivery table 1 is performed on the basis of the closing operation of the normally open contact 5-1. Therefore, even if an operator forgets changing the operation mode selection switch 7-1 from the single operation mode to the automatic operation mode, every time the height of a pile of the sheets 6 stacked on the pile board 4 exceeds the predetermined position, automatic descending of the delivery table 1 is performed. The stacked sheets are not disturbed by the gripper shaft. As a result, printing is not interrupted, and damage to the printing press can be prevented.

In the automatic and single operation modes as described above, even if the delivery height detector 5 detects the height of the pile exceeding the predetermined position for the sheets 6 stacked on the pile board 4, and if the delivery table 1 is not moved downward, the time-limit operation normally open contact Ta is turned on at the end of counting by the time-limit relay T1 on the basis of the closing operation of the normally open contact 5-2 of the delivery height detector 5, i.e., at the end of the predetermined counting time of the time-limit relay T1. The alarm unit 8 is operated upon the ON operation of the time-limit operation normally open contact Ta. An alarm is generated to signal that the delivery table 1 is not moved downward. When the time-limit operation normally open contact Ta is turned on, the time-limit relay T2 is started. When automatic descending of the delivery table 1 is not started upon a lapse of the predetermined time t2 even after the alarm is generated by the alarm unit 8, i.e., when a descending failure of the delivery table 1 is not released, feeding of the sheet to the printing press is immediately interrupted by the opening operation of the time-limit operation normally open contact of the time-limit relay T2. When the counting operation of the time-limit relay T2 is completed, delivery of the sheet to the delivery table 1 is interrupted. By properly setting the time tl of the time-limit relay T1 and the time t2 of the time-limit relay T2, the height of the pile of the sheets 6 stacked on the pile board 4 can be regulated prior to interruption of the printing press and damage thereto which are caused by disturbance of the stacked sheets. Therefore, a safety operation against an accidental failure caused by the failure of automatic descending can be achieved.

Figure 3:
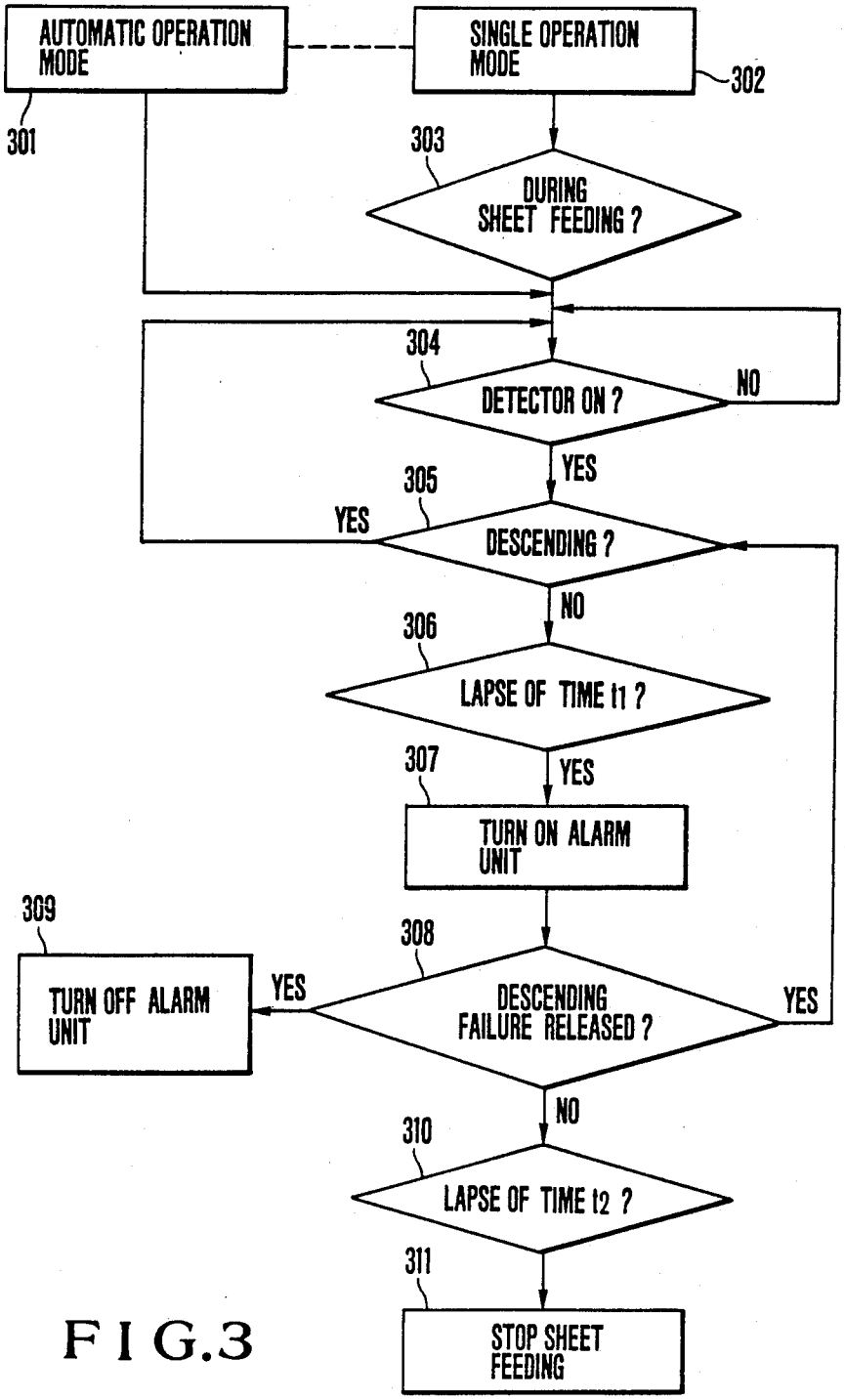
FIG. 3 is a flow chart for explaining the operation of the delivery safety apparatus shown in FIG. 1.

FIG. 3 is a flow chart for explaining the operation of the delivery safety circuit. The operations are designated by step numbers, and a description thereof will be omitted.

In the delivery safety apparatus for a sheet-fed printing press according to the present invention as has been described above, regardless of the operation mode of the delivery table lifting unit, a delivery table is automatically moved downward on the basis of a detection result from a pile height detecting means for detecting a sheet pile height exceeding a predetermined position for sheets delivered and stacked on the delivery table. If automatic descending of the delivery table is not started even when a predetermined period of time has elapsed, this abnormal state is detected, and an alarm is generated. When automatic descending is not yet started when another predetermined period of time has elapsed after the alarm is generated, this abnormal state is detected to interrupt delivery of sheets onto the delivery table. In this manner, automatic descending of the delivery table can be performed regardless of the operation mode of the delivery table lifting unit. When automatic descending of the delivery table is not started after a lapse of another predetermined period of time, an alarm is generated. When automatic descending of the delivery table is not yet started after generation of the alarm and a lapse of another predetermined period of time, delivery of the sheets onto the delivery table is interrupted. Therefore, great improvements are made to prevent interruption of the printing press and its damage, and a safety operation can be achieved.

What is claimed is:

1. A delivery safety apparatus for a sheet-fed printing press, comprising:

delivery height detecting means for detecting a height of a pile exceeding a predetermined position for sheets delivered and stacked on a delivery table;

delivery table automatic descending means for vertically moving said delivery table on the basis of a detection result of said delivery height detecting means regardless of an operation mode of a delivery table lifting unit for vertically moving said delivery table;

alarming means for detecting that automatic descending of said delivery table by said delivery table automatic descending means is not started when a predetermined period of time has elapsed and for generating an alarm; and sheet delivery interrupting means for detecting that automatic descending of said delivery table is not started when another predetermined period of time has elapsed after the alarm is generated and for interrupting delivery of the sheet to said delivery table.

* * * * *